US010820692B2

(12) United States Patent
Ho et al.

(10) Patent No.: US 10,820,692 B2
(45) Date of Patent: Nov. 3, 2020

(54) ANGLE ADJUSTMENT MECHANISM OF STORAGE DRAWER OF DESK FOR KEYBOARD

(71) Applicant: AIDATA CORP. LTD., New Taipei (TW)

(72) Inventors: Chi-Dou Ho, New Taipei (TW); Hsiu-Yi Wu, New Taipei (TW)

(73) Assignee: AIDATA CORP. LTD., New Taipei (TW)

( * ) Notice: Subject to any disclaimer, the term of this patent is extended or adjusted under 35 U.S.C. 154(b) by 69 days.

(21) Appl. No.: 16/400,355

(22) Filed: May 1, 2019

(65) Prior Publication Data

US 2020/0187638 A1 Jun. 18, 2020

(30) Foreign Application Priority Data

Dec. 13, 2018 (TW) ..... 107216931

(51) Int. Cl.
*A47B 21/03* (2006.01)
*A47B 88/919* (2017.01)
*A47B 88/447* (2017.01)

(52) U.S. Cl.
CPC ..... *A47B 21/0314* (2013.01); *A47B 88/447* (2017.01); *A47B 88/919* (2017.01); *A47B 2021/0321* (2013.01); *A47B 2200/0088* (2013.01)

(58) Field of Classification Search
CPC ..... A47B 21/0314; A47B 2021/0321; A47B 2021/0335; A47B 88/919; A47B 88/447; A47B 2200/0088; Y10S 248/918
USPC ..... 248/371, 397, 393; 361/679.2
See application file for complete search history.

(56) References Cited

U.S. PATENT DOCUMENTS 5,294,087 A * 3/1994 Drabczyk ..... A47B 21/007 108/138
6,186,460 B1 * 2/2001 Lin ..... A47B 21/0314 248/278.1
6,257,531 B1 * 7/2001 Penner ..... A47B 21/0314 248/118
6,533,229 B1 * 3/2003 Hung ..... A47B 21/0314 248/276.1
6,938,866 B2 * 9/2005 Kirchhoff ..... A47B 21/0314 248/274.1

(Continued)

*Primary Examiner* — Eret C McNichols
(74) *Attorney, Agent, or Firm* — Alan D. Kamrath; Mayer & Williams PC

(57) ABSTRACT

An angle adjustment mechanism of a storage drawer of a desk for a keyboard contains: two lockers, two connectors, two movable pieces, two retainers, and two adjustment assemblies. The locker includes a locking section and a through orifice. The connector includes a stop plate, a fitting portion, multiple first teeth, and a column. The movable piece includes a connecting section, a passing orifice, and a support section. The retainer includes a first receiving orifice, multiple second teeth, at least one first slot, at least one recess, and at least one second slot. The adjustment assembly includes a drive member having an accommodation space, at least one second protrusion, a second receiving orifice, and a third receiving orifice. The first adjusting member includes a fourth receiving orifice, at least one fourth notch, at least one fifth notch, and a sixth notch. The second adjusting member has at least one post.

8 Claims, 15 Drawing Sheets

(56) References Cited

U.S. PATENT DOCUMENTS

| | | | | |
|---|---|---|---|---|
| 6,971,624 | B2 * | 12/2005 | Kollar | A47B 21/0314 108/137 |
| 7,004,438 | B2 * | 2/2006 | Lin | A47B 21/0314 248/289.11 |
| 7,690,317 | B2 * | 4/2010 | Beck | F16M 11/10 108/143 |
| 8,797,765 | B2 * | 8/2014 | Lin | F16M 13/00 361/807 |
| 8,864,091 | B1 * | 10/2014 | Patriarco | A47B 21/0314 248/316.1 |
| 2003/0042380 | A1 * | 3/2003 | Hagglund | A47B 21/0314 248/286.1 |
| 2005/0105255 | A1 * | 5/2005 | Kirchhoff | A47B 21/0314 361/679.2 |
| 2005/0115475 | A1 * | 6/2005 | Lin | A47B 21/0314 108/102 |
| 2007/0152122 | A1 * | 7/2007 | Kirchhoff | A47B 21/0314 248/283.1 |
| 2009/0031927 | A1 * | 2/2009 | Conley | A47B 9/00 108/146 |
| 2009/0084917 | A1 * | 4/2009 | Hung | A47B 21/0314 248/278.1 |
| 2015/0164221 | A1 * | 6/2015 | Zimmerman | A47B 13/16 108/25 |
| 2016/0192778 | A1 * | 7/2016 | Shen | A47B 21/0314 108/42 |
| 2017/0273454 | A1 * | 9/2017 | Wiener | A47B 21/02 |
| 2017/0295924 | A1 * | 10/2017 | Getz | A47B 21/0314 |
| 2017/0318958 | A1 * | 11/2017 | Asante | F16M 11/28 |
| 2020/0029685 | A1 * | 1/2020 | Du | A47B 21/02 |
| 2020/0140091 | A1 * | 5/2020 | Pence | A47B 1/10 |
| 2020/0196748 | A1 * | 6/2020 | Lu | A47B 9/16 |

* cited by examiner

ANGLE ADJUSTMENT MECHANISM OF STORAGE DRAWER OF DESK FOR KEYBOARD

BACKGROUND OF THE INVENTION

Field of the Invention

The present invention relates to an angle adjustment mechanism which is applied to adjust an angle of a storage drawer of a desk for a keyboard.

Description of the Prior Art

With popularity and advancement of computers, computer desks are classified to a hidden computer desk or a computer desk with a tiltable angle for a desktop panel on which a computer screen is placed. It can protect a user's eyes and avoid serious damage caused by radiation after a period of using time.

However, the computer desks on the market are usually only adjusted for the computer screen, but there is no adjustable angle for the storage drawers on which the keyboard is placed, so the storage drawers can only be pulled out or pushed back under the desktop board. Furthermore, each user's height and arm length are different, so the user's arm cannot be placed on the storage drawer in the most comfortable posture, thus causing the user's muscles to be stiff and sore after a period of using time.

The present invention has arisen to mitigate and/or obviate the afore-described disadvantages.

SUMMARY OF THE INVENTION

The primary objective of the present invention is to provide an angle adjustment mechanism of a storage drawer of a desk for a keyboard which contains two adjustment assemblies moved to the retainer so as to actuate a connector to move, each retainer and the connector remove from a locking section of a locker and a connecting section of a movable piece, and multiple first teeth disengage from multiple second teeth of each retainer respectively, hence the movable piece is rotated to an angle at which a top of a support section connects with a storage drawer, and a user's arm puts on the storage drawer comfortably.

To obtain above-mentioned objectives, an angle adjustment mechanism of a storage drawer of a desk for a keyboard provided by the present invention contains: a locker, a connector, a movable piece, a retainer, and an adjustment assembly.

The locker includes a locking section and a through orifice defined on the locking section.

The connector includes a stop plate, a fitting portion which is hollow and extends from the stop plate, multiple first teeth surrounding around an inner rim of the fitting portion, and a column extending from a center of the connector surrounded by the multiple first teeth, wherein a length of the column is more than the fitting portion, the fitting portion is inserted into the through orifice, and the stop plate contacts with the locking section.

The movable piece includes a connecting section, a passing orifice defined on a center of the connecting section, and a support section perpendicularly bending from a bottom of the connecting section, wherein the connecting section of the movable piece is connected with the locking section of the locker, and the column is inserted into the passing orifice.

The retainer includes a first receiving orifice, multiple second teeth surrounding around a first end of the retainer, at least one first slot and at least one recess which are formed on a second end of the retainer, and at least one second slot defined between and connected with the at least one first slot and the at least one recess, wherein the retainer is mounted between the connecting section and the support section of the movable piece, the multiple second teeth are inserted through the passing orifice to engage with the multiple first teeth respectively, and the first receiving orifice accommodates the column.

The adjustment assembly is secured between the connecting section and the support section, and the adjustment assembly includes: a drive member, a first adjusting member, and a second adjusting member.

The drive member has an accommodation space defined in an end of the drive member, at least one second protrusion received in the accommodation space, a second receiving orifice formed in the other end of the drive member, and a third receiving orifice communicating with the accommodation space and the second receiving orifice, wherein the accommodation space is fitted with the at least one first slot, the at least one recess and the at least one second slot. The at least one second protrusion is movably fixed into the at least one first slot, the at least one recess and the at least one second slot, and the third receiving orifice accommodates the column.

The first adjusting member includes a fourth receiving orifice defined in the first adjusting member, at least one fourth notch and at least one fifth notch which are defined on a center of the first adjusting member and communicate with the fourth receiving orifice, and a sixth notch defined between and parallel to the at least one fourth notch and the at least one fifth notch, wherein the first adjusting member is accommodated in the second receiving orifice.

The second adjusting member has at least one post extending from a first end of the second adjusting member, wherein the second adjusting member is accommodated in the fourth receiving orifice, and the at least one post is movably fixed into the at least one fourth notch, the at least one fifth notch and the sixth notch.

DETAILED DESCRIPTION OF THE PREFERRED EMBODIMENTS

Figure 1:
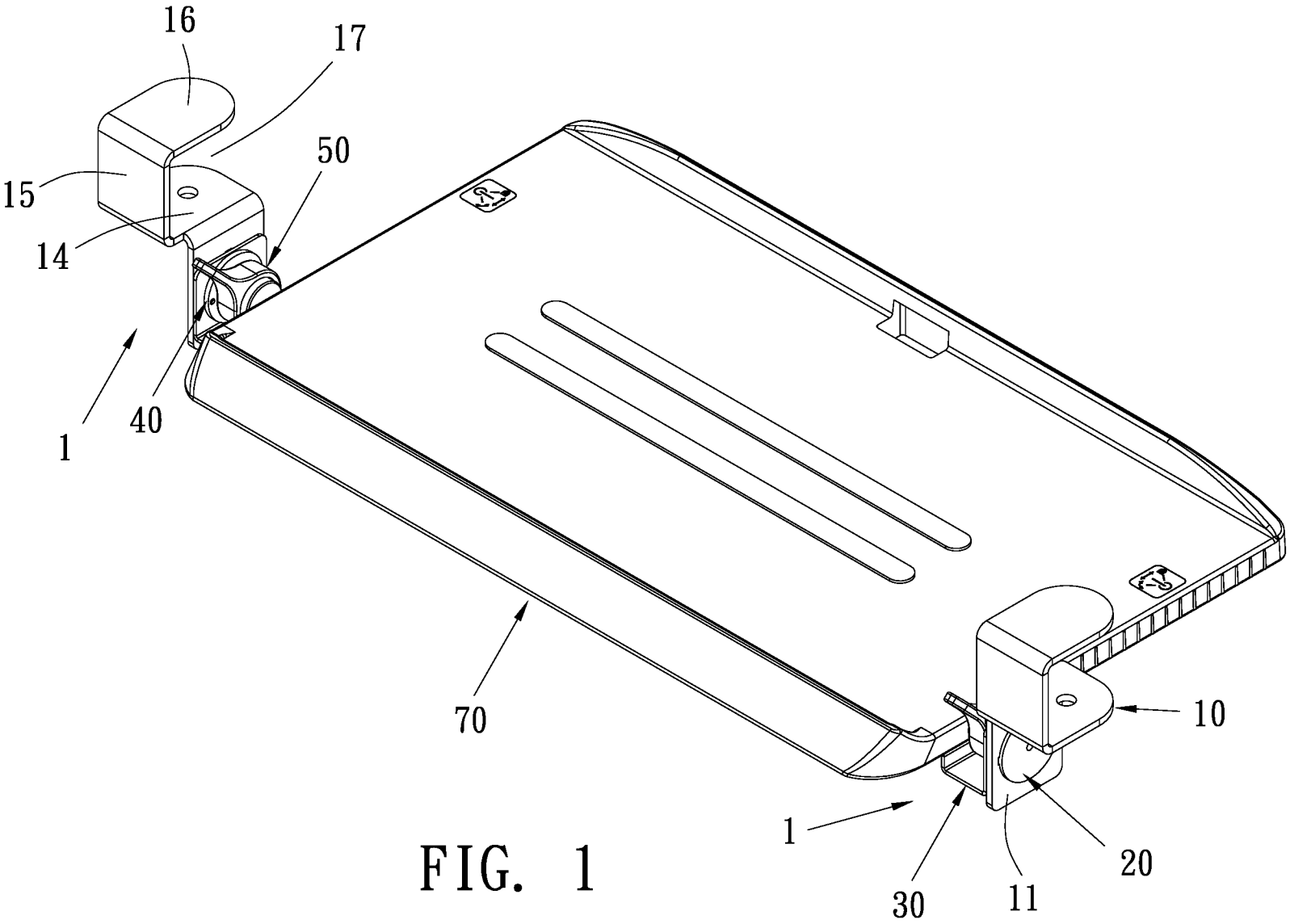
FIG. 1 is a perspective view showing the assembly of an angle adjustment mechanism and a storage drawer of a desk for a keyboard according to a preferred embodiment of the present invention.
Figure 2:
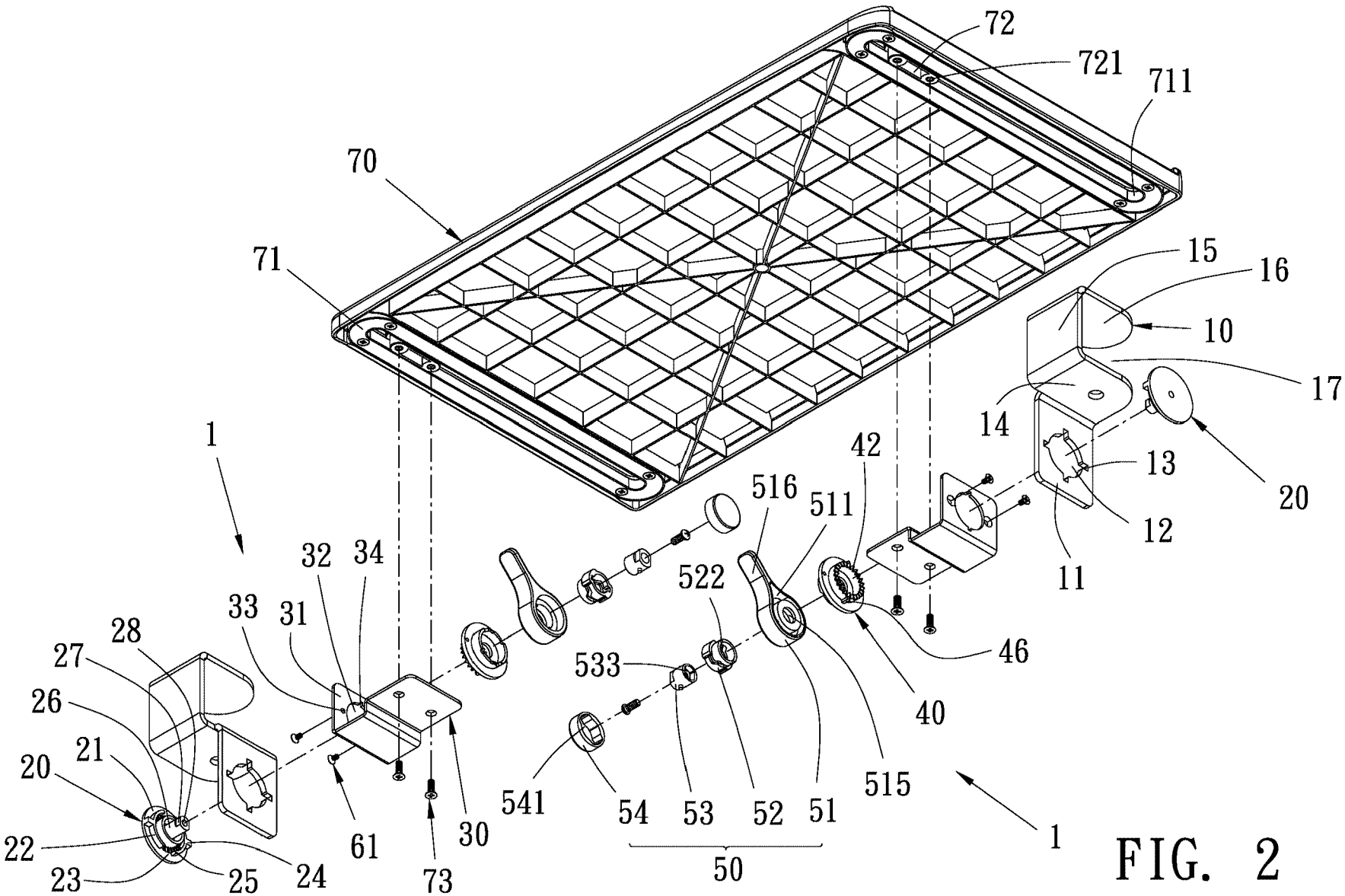
FIG. 2 is a perspective view showing the exploded components of the angle adjustment mechanism and the storage drawer of the desk for the keyboard according to the preferred embodiment of the present invention.
Figure 3:
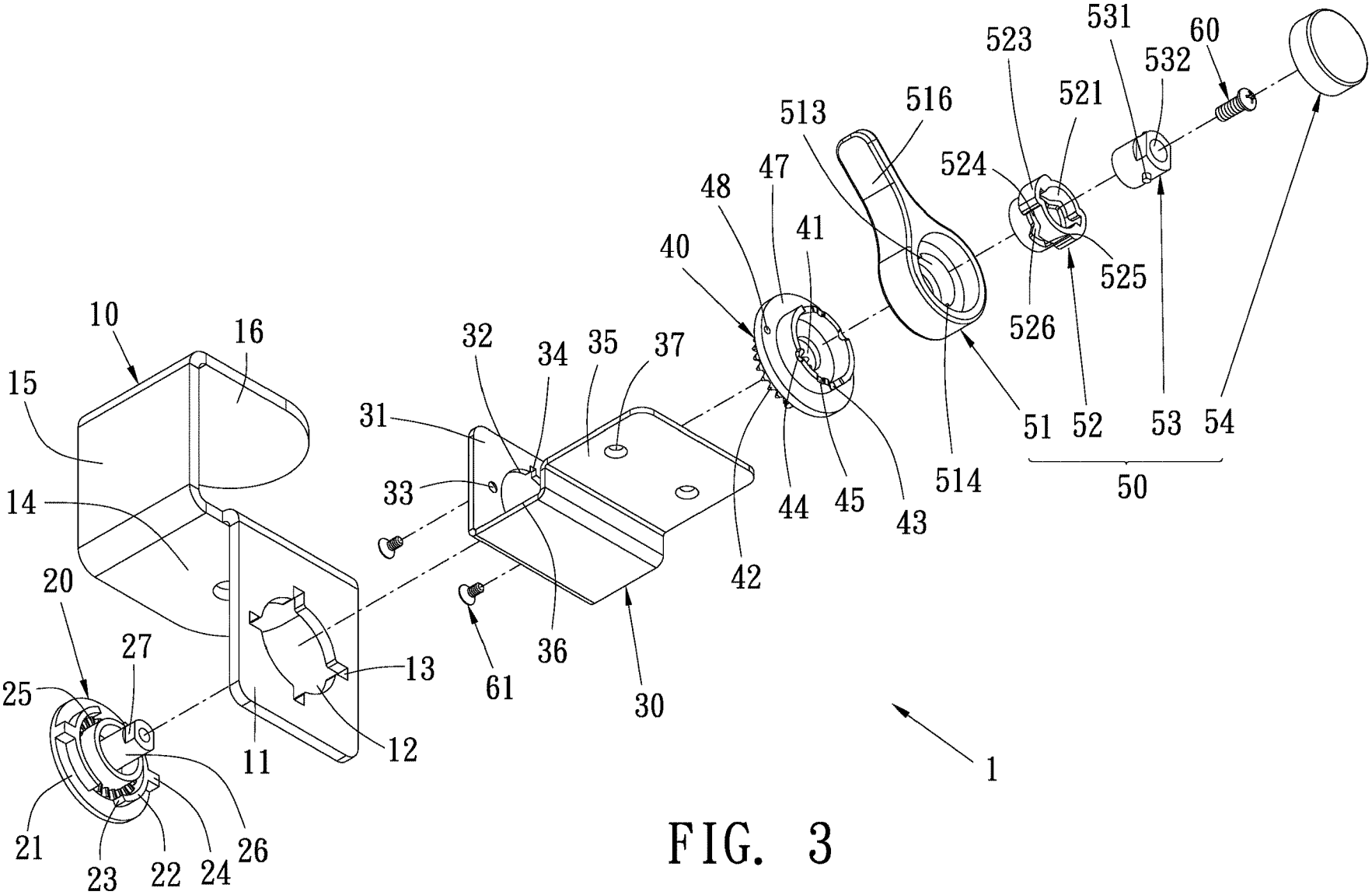
FIG. 3 is another perspective view showing the exploded components of the angle adjustment mechanism according to the preferred embodiment of the present invention.
Figure 4:
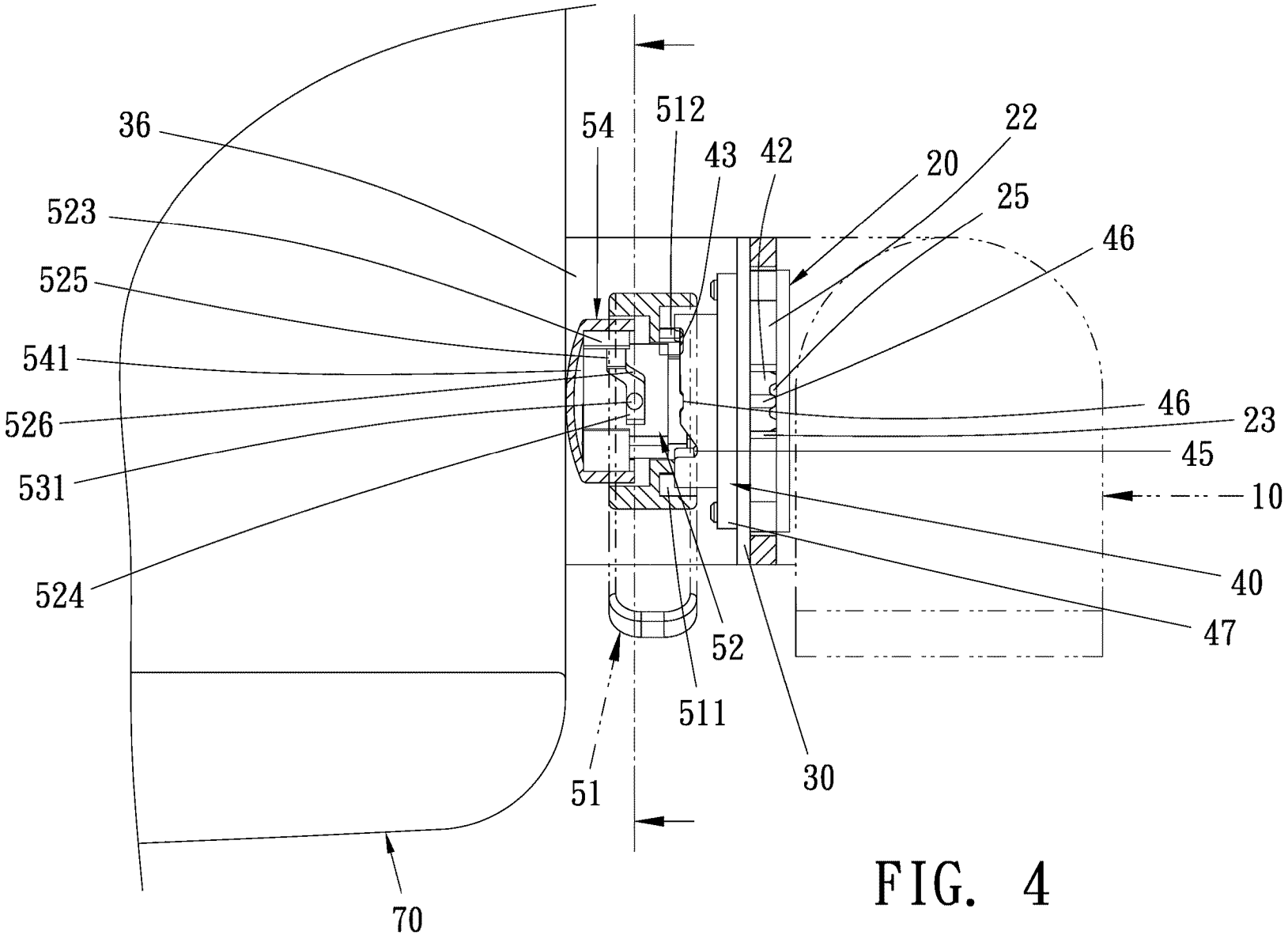
FIG. 4 is a cross sectional view showing the assembly of the angle adjustment mechanism according to the preferred embodiment of the present invention.
Figure 5:
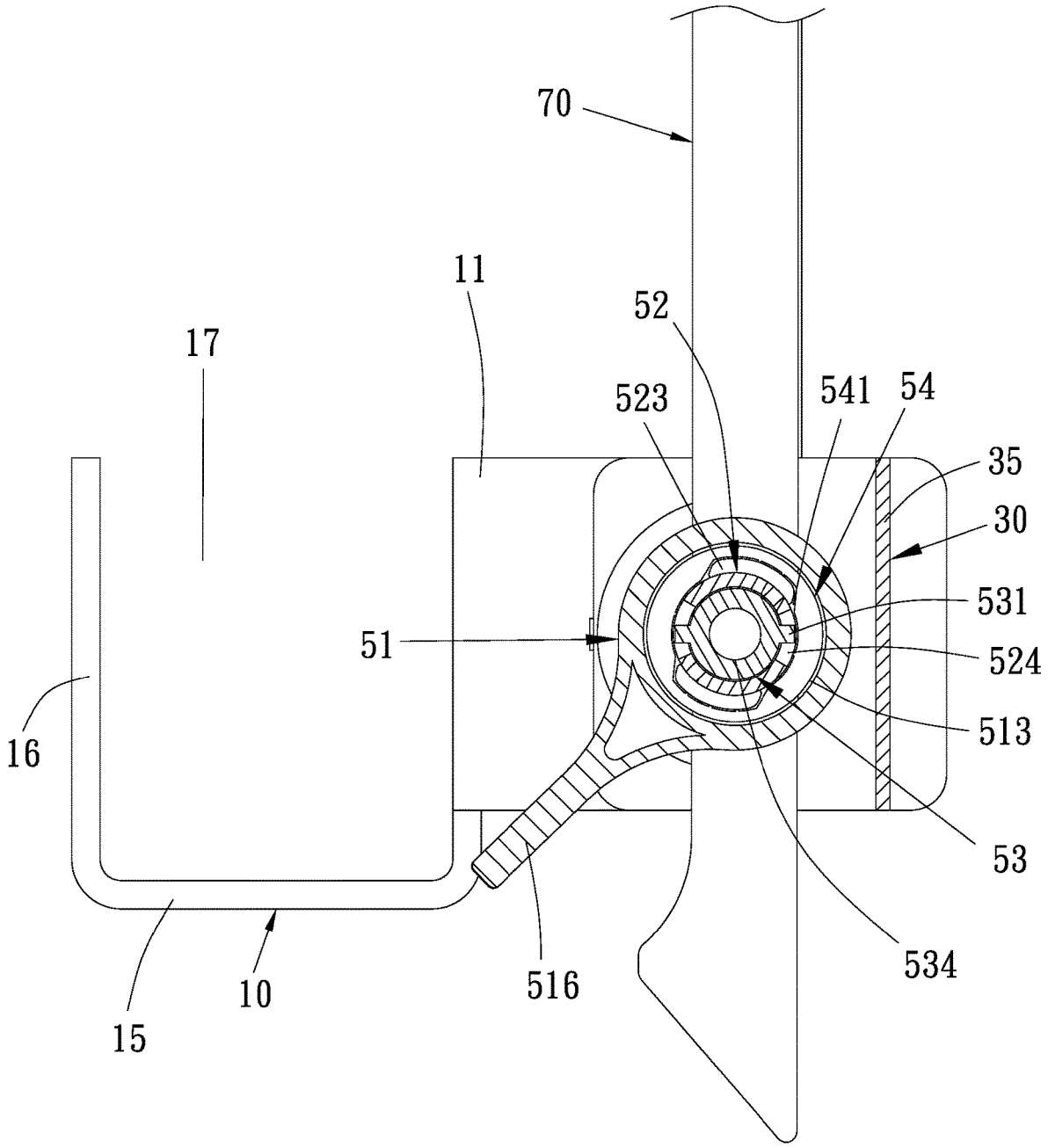
FIG. 5 is a cross sectional view taken along the line of FIG. 4.
Figure 6:
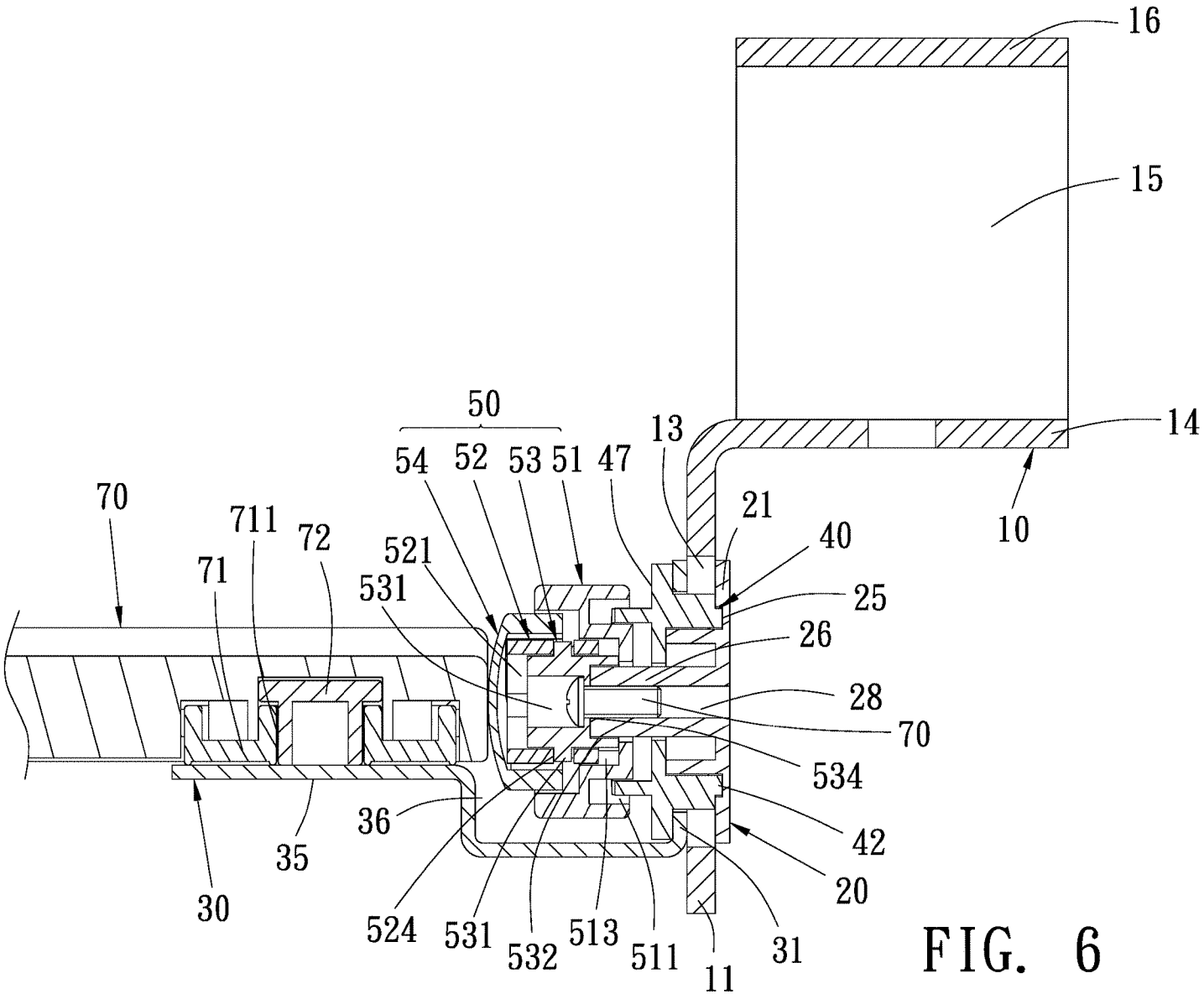
FIG. 6 is a cross sectional view showing the assembly of the angle adjustment mechanism according to the preferred embodiment of the present invention.

The present invention will be clearer from the following description when viewed together with the accompanying drawings, which show, for purpose of illustrations only, a preferred embodiment in accordance with the present invention. In operation, two angle adjustment mechanisms of the present invention are mounted on two ends of a storage drawer of a desk for a keyboard. Accordingly, we take an angle adjustment mechanism for example in following description of the structure.

With reference to FIGS. 1-6, an angle adjustment mechanism 1 of a storage drawer of a desk for a keyboard according to a preferred embodiment of the present invention comprises: a locker 10, a connector 20, a movable piece 30, a retainer 40, an adjustment assembly 50, a first screwing element 60, and two second screwing elements 61 which are screwed on two ends of the storage drawer 70 respectively by using the angle adjustment mechanism 1.

The locker 10 includes a locking section 11, a through orifice 12 defined on the locking section 11, at least one first notch 13 formed inside the through orifice 12, a first engagement section 14 bending and extending from a top of the locking section 11 perpendicular to the locking section 11, a bending section 15 extending from the first engagement section 14 opposite to the locking section 11 and perpendicular to the first engagement section 14, a second engagement section 16 bending from a distal end of the bending section 15 opposite to the first engagement section 14 so that an opening 17 is defined between the first engagement section 14 and the second engagement section 16.

The connector 20 includes a stop plate 21, a fitting portion 22 which is hollow and extends from the stop plate 21, wherein a diameter of the fitting portion 22 is less than the stop plate 21, and the connector 20 includes at least one cutout 23 formed thereon, at least one shoulder 24 arranged on an outer rim of the fitting portion 22, multiple first teeth 25 surrounding around an inner rim of the fitting portion 22, and a column 26 extending from a center of the connector 20 surrounded by the multiple first teeth 25, wherein a length of the column 26 is more than the fitting portion 22. The connector 20 further includes a first coupling portion 27 located on an end of the column 26 opposite to the stop plate 21, and a first threaded orifice 28 passing through the stop plate 21 and the column 26, wherein the fitting portion 22 of the connector 21 is inserted into the through orifice 12 of the locker 10, the at least one shoulder 24 is fixed in the at least one first notch 13 respectively, and the stop plate 21 contacts with the locking section 11.

The movable piece 30 includes a connecting section 31, a passing orifice 32 defined on a center of the connecting section 31, two opposite first fixing orifices 33 concentric with the passing orifice 32, at least one second notch 34 formed inside the passing orifice 32, a support section 35 perpendicularly bending from a bottom of the connecting section 31, an indentation 36 defined between the connecting section 31 and the support section 35, and two first joining orifice 37 formed adjacent to an end of the support section 35 opposite to the connecting section 31, wherein the connecting section 31 of the movable piece 30 is connected with the locking section 11 of the locker 10, and the column 26 is inserted into the passing orifice 32.

The retainer 40 includes a first receiving orifice 41, multiple second teeth 42 surrounding around a first end of the retainer 40, at least one first slot 43 and at least one recess 44 which are formed on a second end of the retainer 40, and at least one second slot 45 defined between and connected with the at least one first slot 43 and the at least one recess 44, wherein a depth of the at least one recess 44 is more than those of the at least one second slot 45 and the at least one first slot 43, the retainer 40 further includes at least one first protrusion 46 arranged on an end of the multiple second teeth 42, a circular abutting portion 47 surrounding around a center of the retainer 40, two opposite second fixing orifices 48 defined on the circular abutting portion 47 and concentric with the first receiving orifice 41, wherein the retainer 40 is mounted between the connecting section 31 and the support section 35 of the movable piece 30, the multiple second teeth 42 are inserted through the passing orifice 32 to engage with the multiple first teeth 25 respectively, a first end of each of the at least one first protrusion 46 is engaged by each of the at least one second notch 34, and a second end of each first protrusion 46 is located inside each of the at least one cutout 23, the first receiving orifice 41 accommodates the column 26, and the circular abutting portion 47 is limited by the connecting section 31.

The adjustment assembly 50 is secured between the connecting section 31 and the support section 35, and the adjustment assembly 50 includes a drive member 51, a first adjusting member 52, a second adjusting member 53, and a cap 54.

The drive member 51 has an accommodation space 511 defined in an end thereof, at least one second protrusion 512 received in the accommodation space 511, a second receiving orifice 513 formed in the other end of the drive member 51, at least one third protrusion 514 accommodated in the second receiving orifice 513, a third receiving orifice 515 communicating with the accommodation space 511 and the second receiving orifice 513, and a pull portion 516 extending from the drive member 51, wherein the accommodation space 511 of the drive member 51 is fitted with the at least one first slot 43, the at least one recess 44, and the at least one second slot 45 of the retainer 40, the at least one second protrusion 512 is movably fixed into the at least one first slot 43, the at least one recess 44 and the at least one second slot 45, and the third receiving orifice 515 accommodates the column 26.

The first adjusting member 52 includes a fourth receiving orifice 521 defined therein, at least one third notch 522 formed on a first outer surface of the first adjusting member 52, at least one second coupling portion 523 arranged on a second outer surface of the first adjusting member 52, at least one fourth notch 524 and at least one fifth notch 525 which are defined on a center of the first adjusting member 52 and communicate with the fourth receiving orifice 521, and a sixth notch 526 defined between and parallel to the at least one fourth notch 524 and the at least one fifth notch 525, wherein the first adjusting member 52 is accommodated in the second receiving orifice 513, and the at least one third notch 522 is engaged with the at least one third protrusion 514 respectively.

The second adjusting member 53 has at least one post 531 extending from a first end thereof, a fifth receiving orifice 532 formed in the second adjusting member 53, a sixth receiving orifice 533 defined in a second end of the second adjusting member 53, and a second threaded orifice 534 defined between and communicating with the fifth receiving orifice 532 and the sixth receiving orifice 533, wherein the second adjusting member 53 is accommodated in the fourth receiving orifice 521, the at least one post 531 is movably fixed into the at least one fourth notch 524, the at least one fifth notch 525 and the sixth notch 526, and the sixth receiving orifice 533 is connected with the first coupling portion 27.

The cap 54 includes a second joining orifice 541 defined thereon and is received in the second receiving orifice 513 of the drive member 51, and the second joining orifice 541 is fitted with the at least one second coupling portion 523.

The first screwing element 60 is accommodated in the fifth receiving orifice 532 of the second adjusting member 53 and is inserted through the second threaded orifice 534 and the first threaded orifice 28 of the connector 20 so that the second adjusting member 53 is screwed with the connector 20.

The two second screwing elements 61 are inserted through the two opposite first fixing orifices 33 of the movable piece 30 and the two opposite second fixing orifices 48 of the retainer 40 respectively so that the movable piece 30 is connected with the retainer 40.

The storage drawer 70 includes two slide rails 71 arranged on two bottoms of two ends thereof respectively, and each of the two slide rails 71 has an elongated groove 711 defined on a center of each slide rail 71, a slidable block 72 and two third screwing elements 73, wherein the slidable block 72 has two third joining orifices 721 defined on a center thereof and are accommodated in the elongated groove 711, the two third screwing elements 73 are inserted through the two first joining orifice 37 of the movable piece 30 and the two third joining orifices 721 of the slidable block 72 individually so that the slidable block 72 is connected with the movable piece 30.

Figure 7:
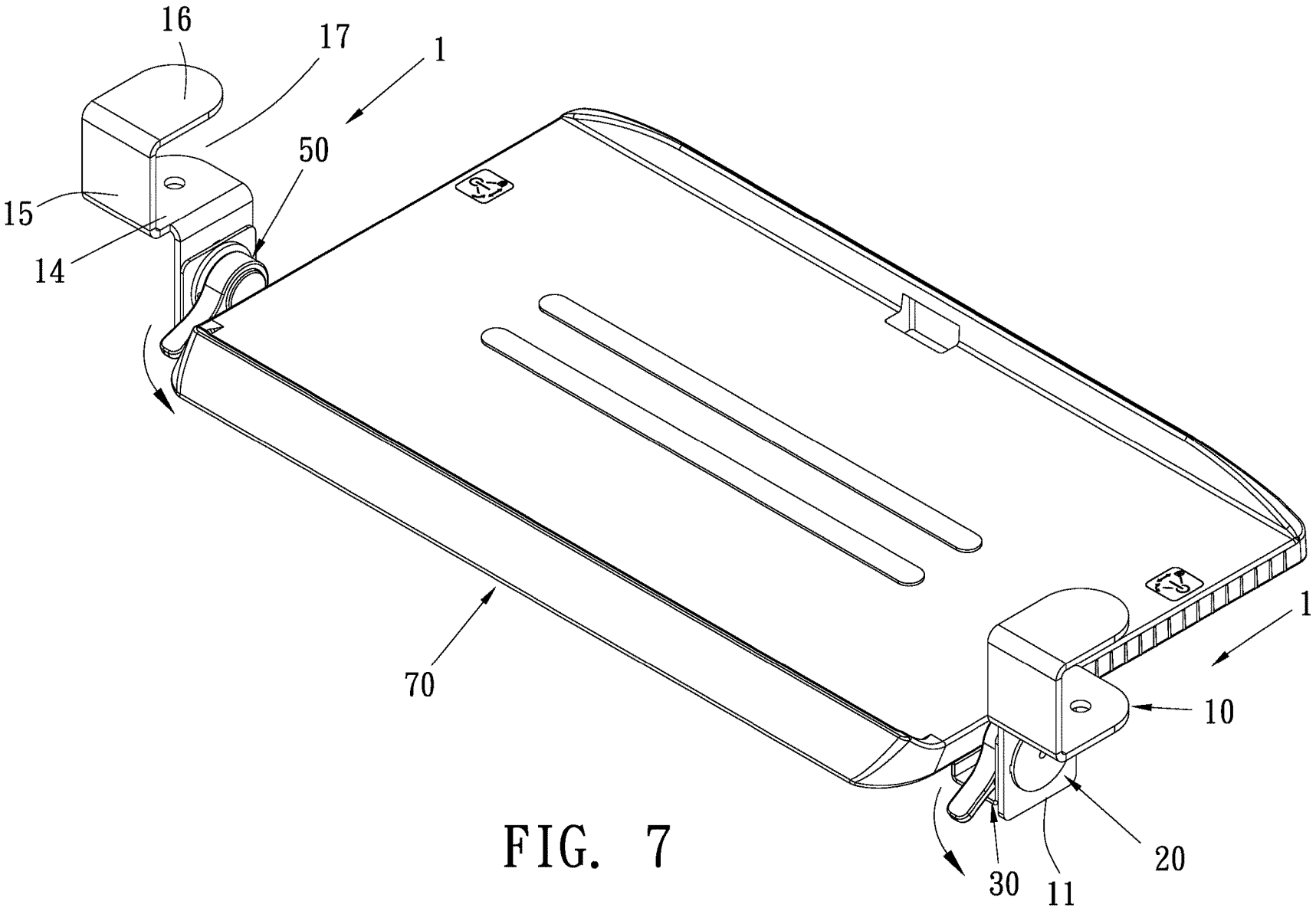
FIG. 7 is a perspective view showing the operation of the angle adjustment mechanism according to the preferred embodiment of the present invention.
Figure 8:
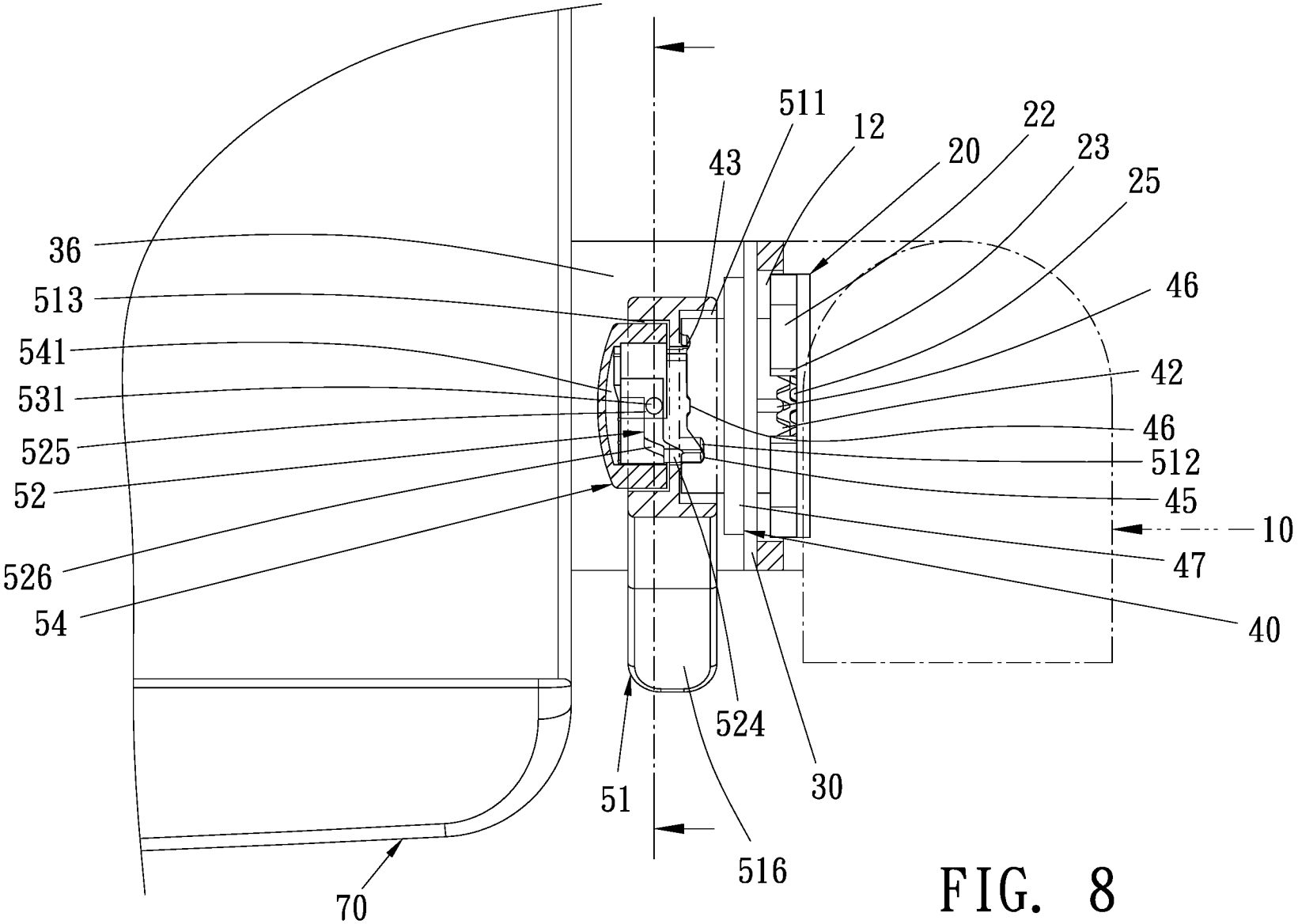
FIG. 8 is a cross sectional view showing the operation of the angle adjustment mechanism according to the preferred embodiment of the present invention.
Figure 9:
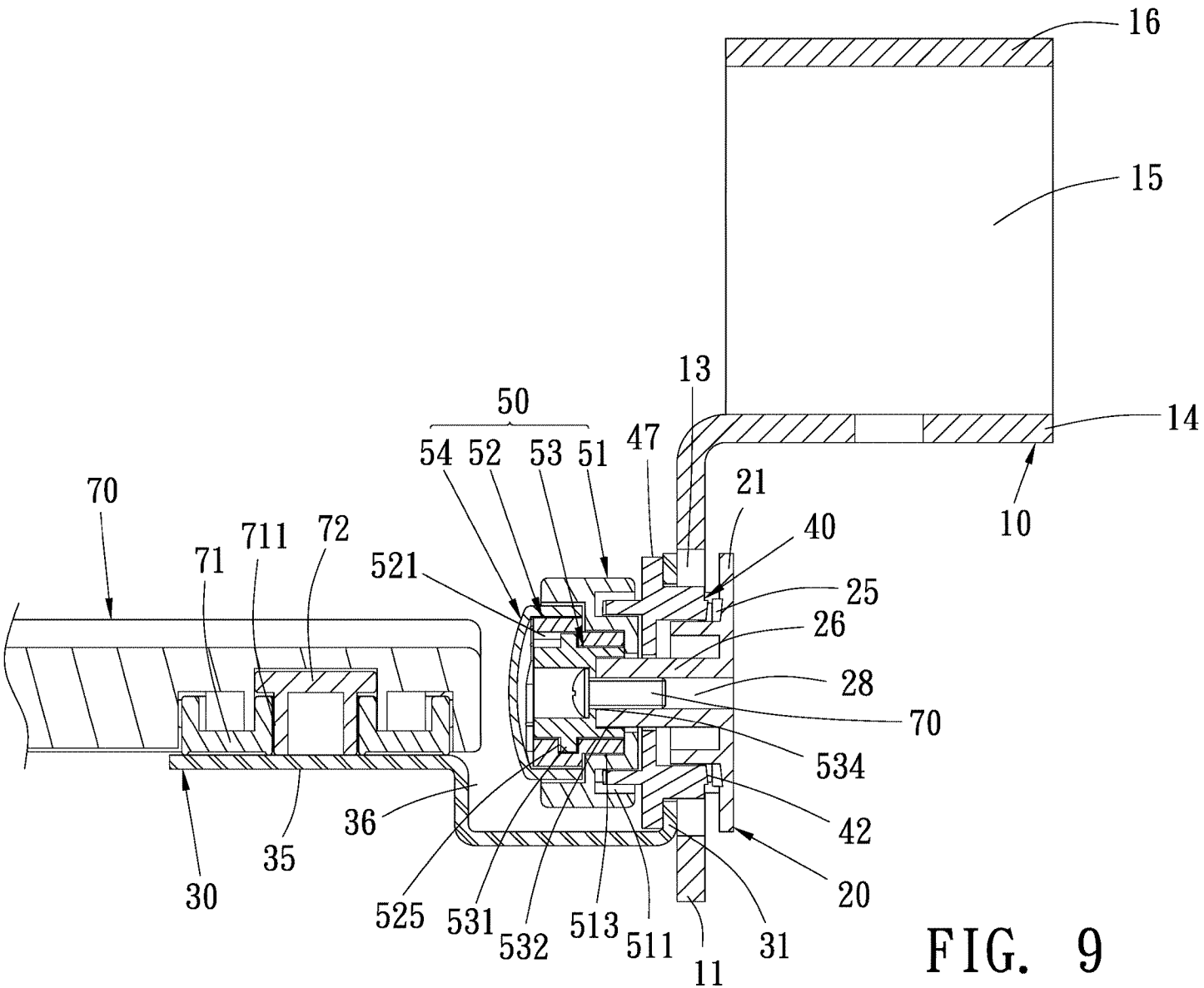
FIG. 9 is another cross sectional view showing the operation of the angle adjustment mechanism according to the preferred embodiment of the present invention.
Figure 10:
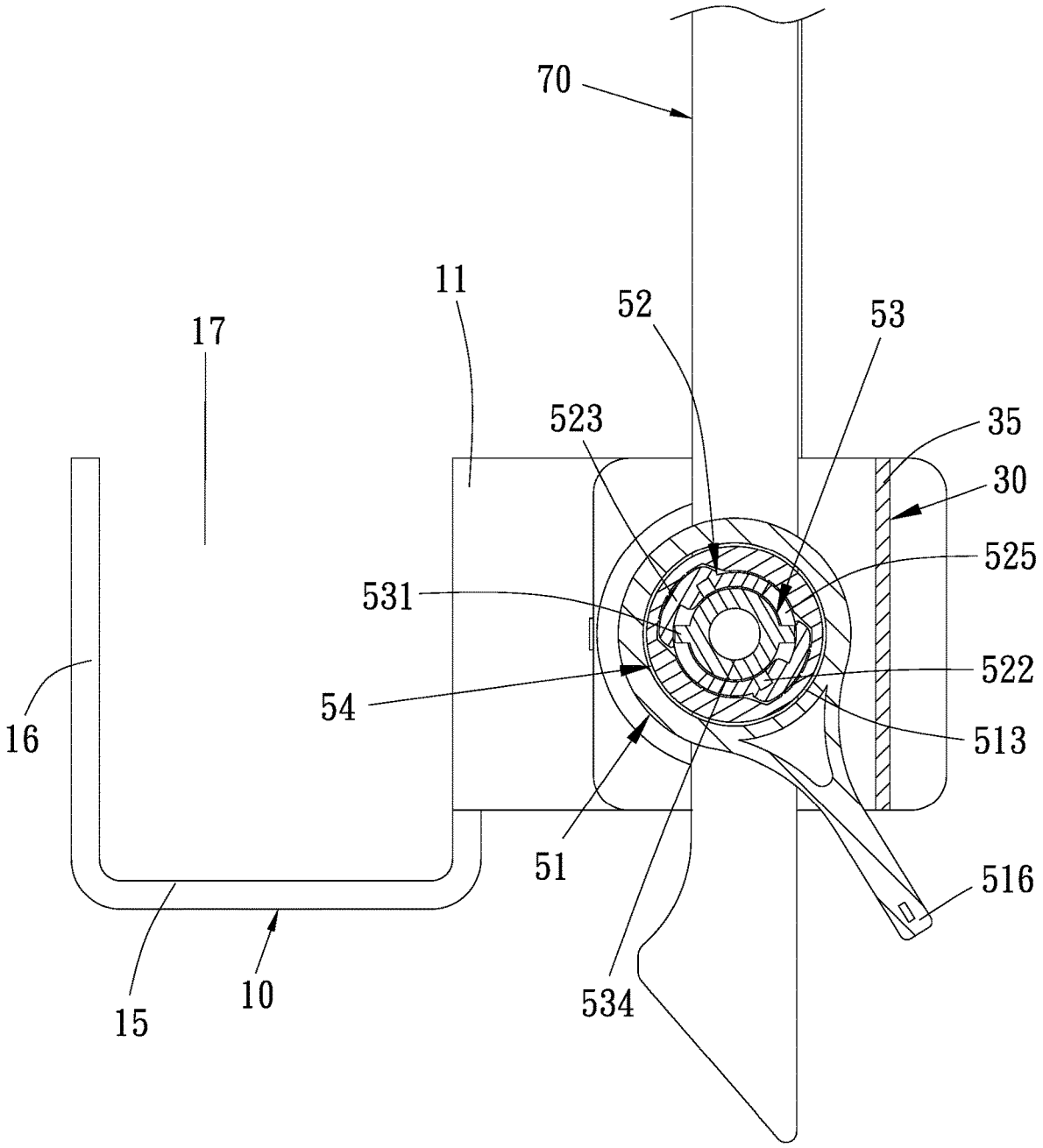
FIG. 10 is a cross sectional view taken along the line of FIG. 8.
Figure 11:
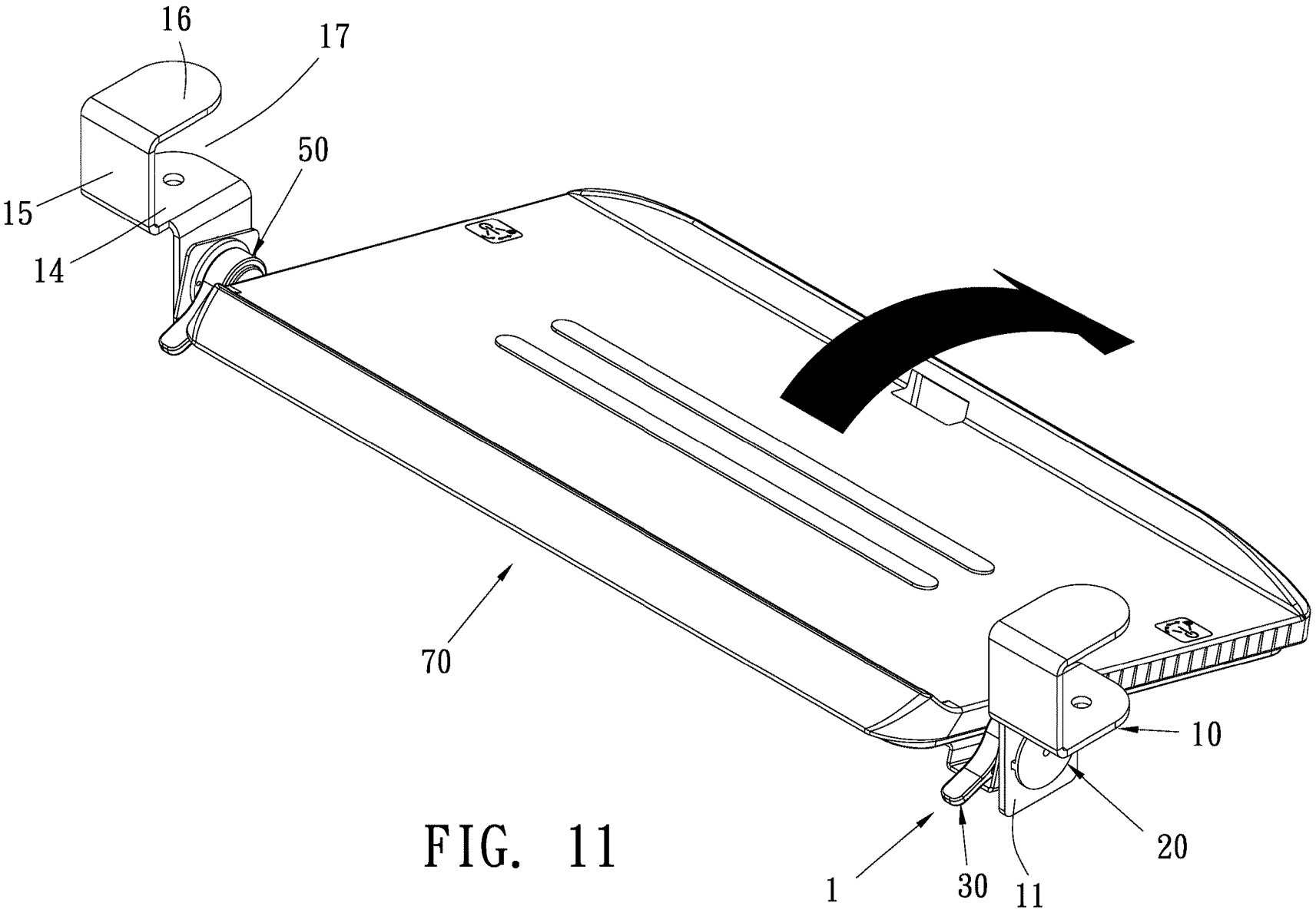
FIG. 11 is another perspective view showing the operation of the angle adjustment mechanism according to the preferred embodiment of the present invention.
Figure 12:
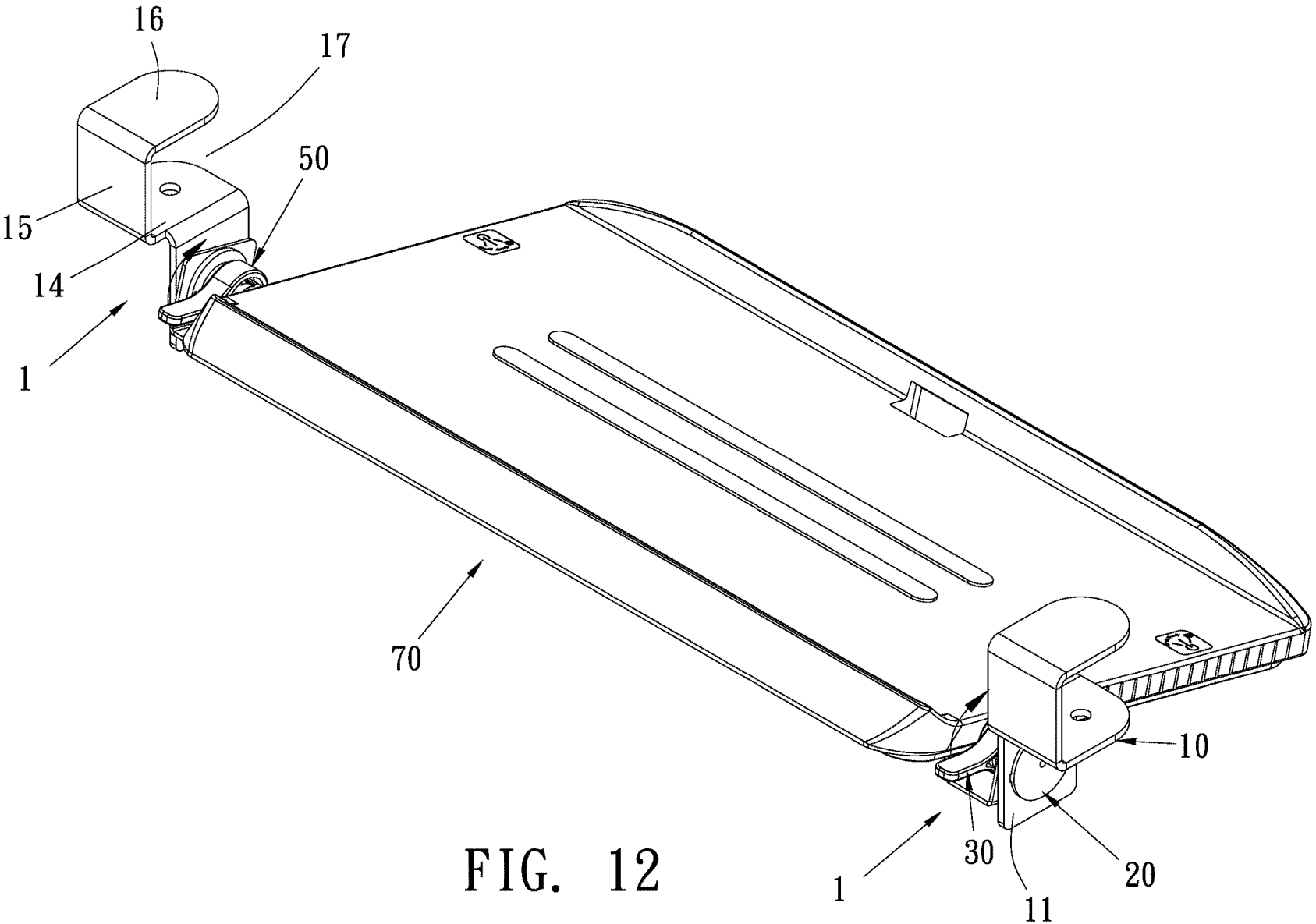
FIG. 12 is also another perspective view showing the operation of the angle adjustment mechanism according to the preferred embodiment of the present invention.
Figure 13:
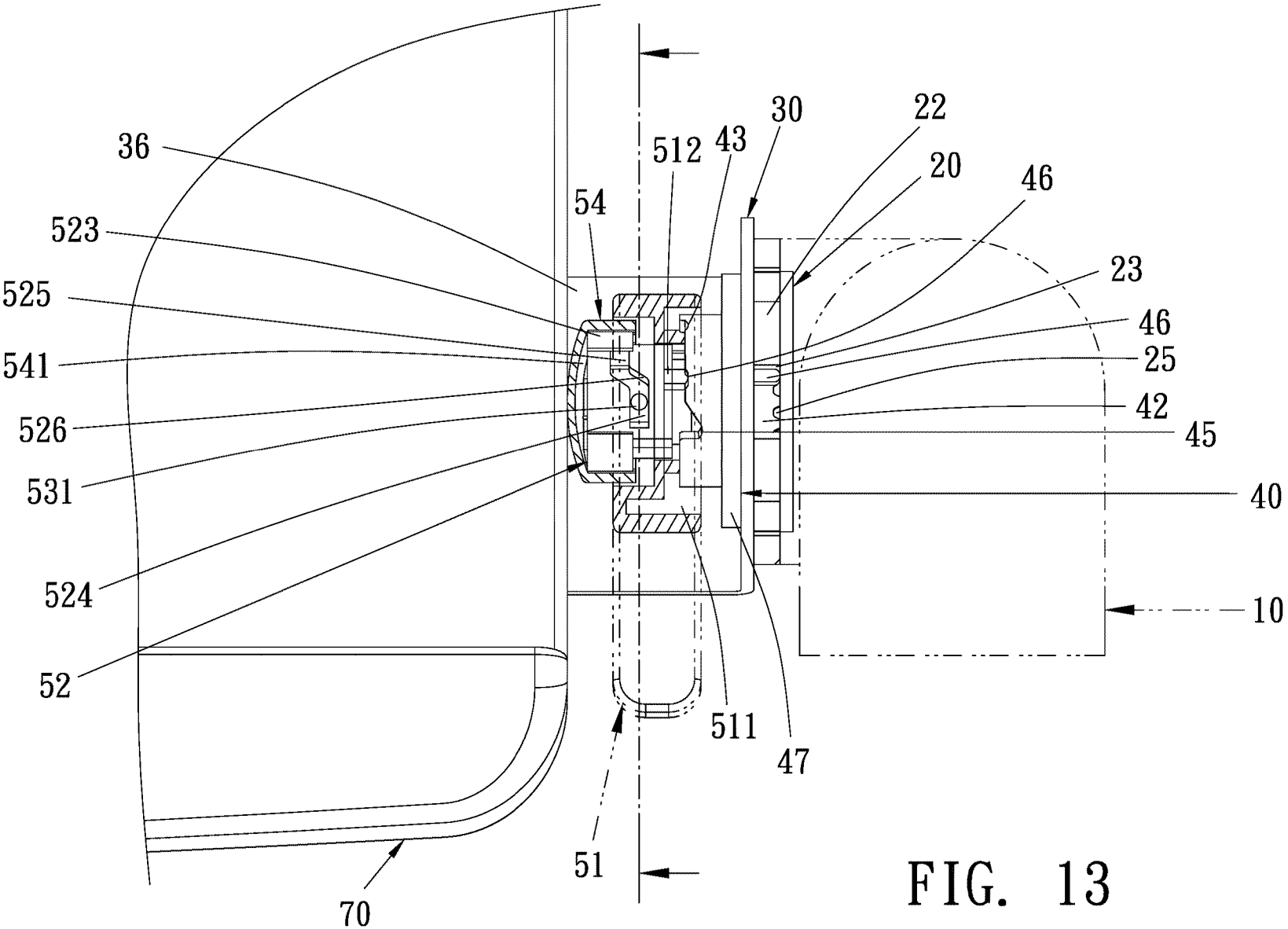
FIG. 13 is still another cross sectional view showing the operation of the angle adjustment mechanism according to the preferred embodiment of the present invention.
Figure 14:
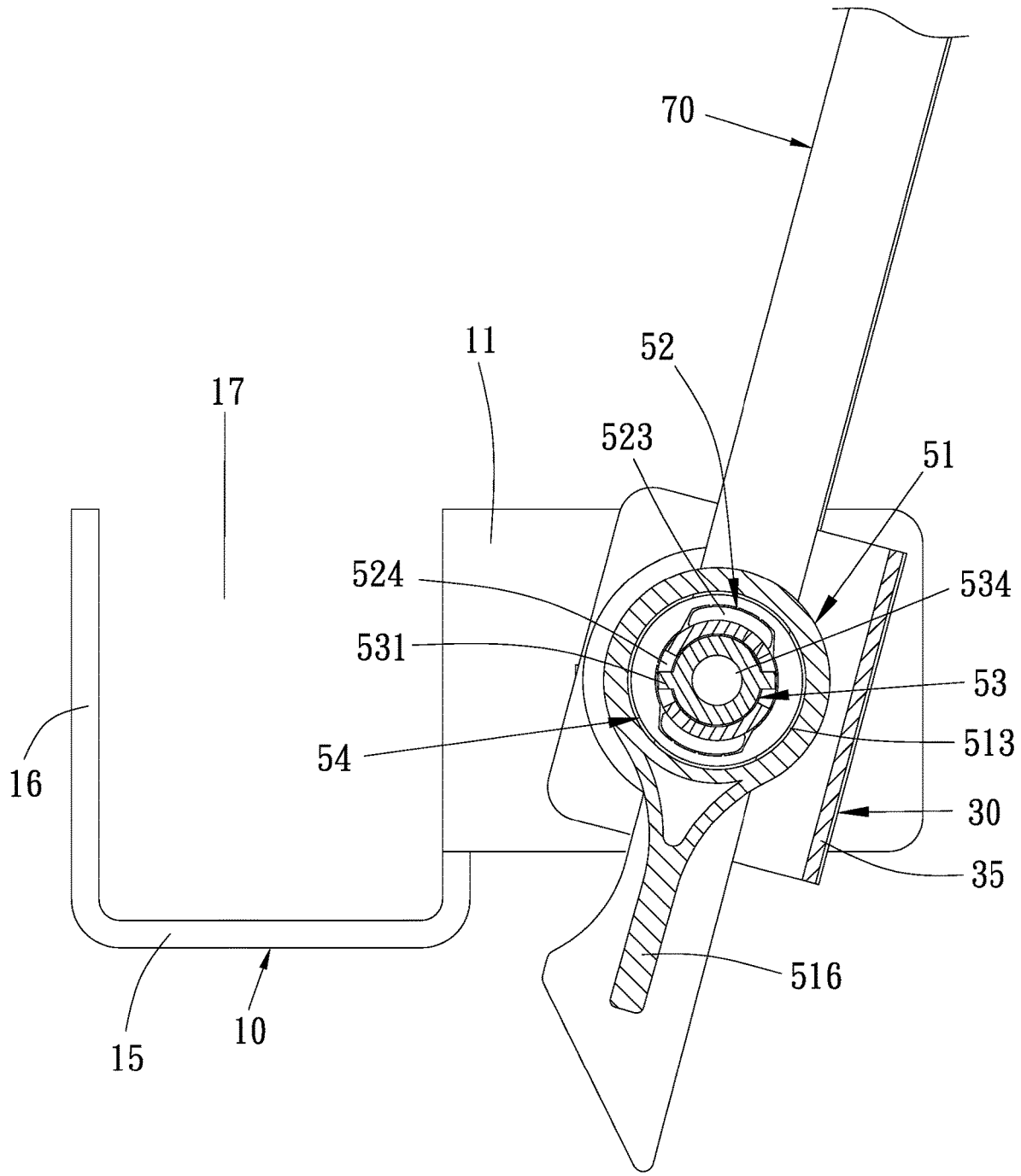
FIG. 14 is a cross sectional view taken along the line of FIG. 13.
Figure 15:
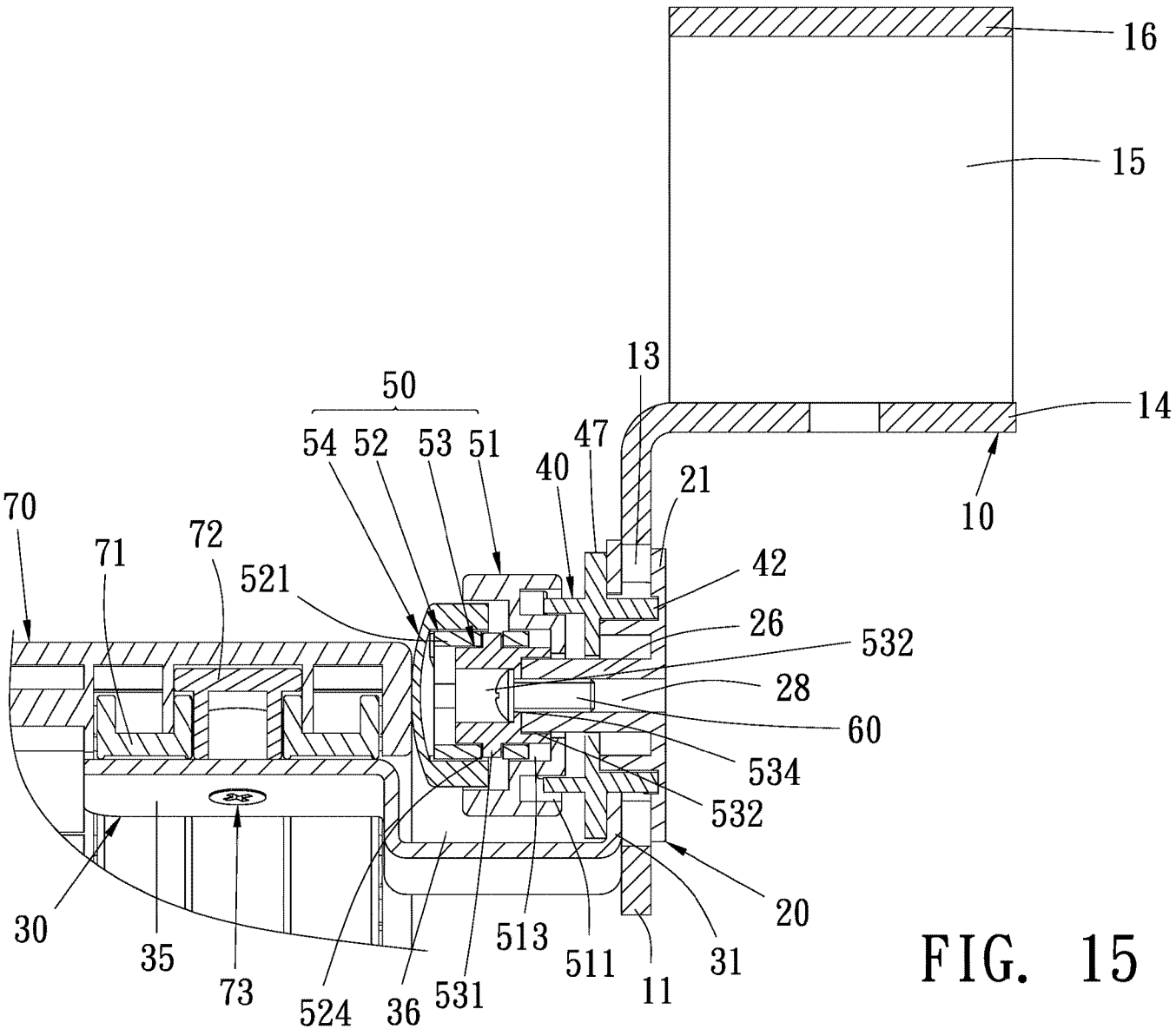
FIG. 15 is another cross sectional view showing the operation of the angle adjustment mechanism according to the preferred embodiment of the present invention.

Referring to FIG. 7, in operation, the drive member 51 of the adjustment assembly 50 is rotated to drive the pull portion 516 to move into the indentation 36 of the movable piece 30 so that the drive member 51 is not interfered by the support section 35 of the movable piece 30, as shown in FIGS. 8-10, and when the drive member 51 is rotated to actuate the first adjusting member 52 to revolve, the at least one fourth notch 524 of the first adjusting member 52 rotates along the at least one post 531 of the second adjusting member 53, and the first adjusting member 52 forces the least one post 531 to move into the at least one fifth notch 525 by rotating the sixth notch 526. The at least one second protrusion 512 of the drive member 51 is moved into the at least one recess 44 of the retainer 40 from the at least one first slot 43 so that the adjustment assembly 50 are moved to the circular abutting portion 47 of the retainer 40 to drive the connector 20 to move, hence the circular abutting portion 47 of the retainer 40 and the stop plate 21 of the connector 20 remove from the locking section 11 of the locker 10 and the connecting section 31 of the movable piece 30, and the multiple first teeth 25 of the connector 20 disengage from the multiple second teeth 42 of the retainer 40 respectively, as illustrated in FIG. 11. Thereafter, the movable piece 30 is rotated to an angle so that the top of the support section 35 of the movable piece 30 connects with the storage drawer 70, and after the movable piece 30 is rotated again, the at least one first protrusion 46 of the retainer 40 is engaged by the cutout 23 of the connector 20 to avoid increase an rotation angle. With reference to FIGS. 12-15, after the pull portion 516 is forced to rotate the drive member 51, by which the first adjusting member 52 is actuated, the at least one fifth notch 525 moves along the at least one post 531, and the at least one post 531 is moved into the at least one fourth notch 524 by ways of the sixth notch 526. Furthermore, the at least one second protrusion 512 of the drive member 51 is moved into the at least one second slot 45 of the retainer 40 from the at least one recess 44 so that the two adjustment assemblies 50 are moved opposite to the circular abutting portion 47 of the retainer 40, the circular abutting portion 47 and the stop plate 21 press the locking section 11 and the connecting section 31, and the multiple first teeth 25 engage with the multiple second teeth 42 of the retainer 40 respectively so that the movable piece 30 does not move, and a user's arm puts on the storage drawer 70 comfortably.

Thereby, the angle adjustment mechanism of the present invention has advantage as follows:

The adjustment assembly 50 are moved to the retainer 40 to actuate the connector 20 to move so that the retainer 40 and the connector 20 remove from the locking section 11 of the locker 10 and the connecting section 31 of the movable piece 30, and the multiple first teeth 25 disengage from the multiple second teeth 42 of the retainer 40 respectively, hence the movable piece 30 is rotated to the angle at which the top of the support section 35 connects with the storage drawer 70, and the user's arm puts on the storage drawer 70 comfortably.

While various embodiments in accordance with the present invention have been shown and described, it is clear to those skilled in the art that further embodiments may be made without departing from the scope of the present invention.

What is claimed is:

1. An angle adjustment mechanism of a storage drawer of a desk for a keyboard comprising:

a locker including a locking section and a through orifice defined on the locking section;

a connector including a stop plate, a fitting portion which is hollow and extending from the stop plate, multiple first teeth surrounding around an inner rim of the fitting portion, and a column extending from a center of the connector surrounded by the multiple first teeth, wherein a length of the column is more than the fitting portion, the fitting portion is inserted into the through orifice, and the stop plate contacts with the locking section;

a movable piece including a connecting section, a passing orifice defined on a center of the connecting section, and a support section perpendicularly bending from a bottom of the connecting section, wherein the connecting section of the movable piece is connected with the locking section of the locker, and the column is inserted into the passing orifice;

a retainer including a first receiving orifice, multiple second teeth surrounding around a first end of the retainer, at least one first slot and at least one recess which are formed on a second end of the retainer, and at least one second slot defined between and connected with the at least one first slot and the at least one recess, wherein the retainer is mounted between the connecting section and the support section of the movable piece, the multiple second teeth are inserted through the passing orifice to engage with the multiple first teeth respectively, and the first receiving orifice accommodates the column; and an adjustment assembly is secured between the connecting section and the support section, and the adjustment assembly including:

a drive member having an accommodation space defined in an end of the drive member, at least one second protrusion received in the accommodation space, a second receiving orifice formed in the other end of the drive member, and a third receiving orifice communicating with the accommodation space and the second receiving orifice, wherein the accommodation space is fitted with the at least one first slot, the at least one recess and the at least one second slot, the at least one second protrusion is movably fixed into the at least one first slot, the at least one recess and the at least one second slot, and the third receiving orifice accommodates the column;

a first adjusting member including a fourth receiving orifice defined in the first adjusting member, at least one fourth notch and at least one fifth notch which are defined on a center of the first adjusting member and communicate with the fourth receiving orifice, and a sixth notch defined between and parallel to the at least one fourth notch and the at least one fifth notch, wherein the first adjusting member is accommodated in the second receiving orifice; and a second adjusting member having at least one post extending from a first end of the second adjusting member, wherein the second adjusting member is accommodated in the fourth receiving orifice, and the at least one post is movably fixed into the at least one fourth notch, the at least one fifth notch and the sixth notch.

2. The angle adjustment mechanism as claimed in claim 1, wherein the locker further includes at least one first notch formed inside the through orifice, a first engagement section bending and extending from a top of the locking section perpendicular to the locking section, a bending section extending from the first engagement section opposite to the locking section and perpendicular to the first engagement section, a second engagement section bending from a distal end of the bending section opposite to the first engagement section so that an opening is defined between the first engagement section and the second engagement section.

3. The angle adjustment mechanism as claimed in claim 2, wherein the connector further includes at least one cutout formed thereon, at least one shoulder arranged on an outer rim of the fitting portion, a first coupling portion located on an end of the column opposite to the stop plate, and a first threaded orifice passing through the stop plate and the column, wherein the at least one shoulder is fixed in the at least one first notch.

4. The angle adjustment mechanism as claimed in claim 3, wherein the movable piece further includes two opposite first fixing orifices concentric with the passing orifice, at least one second notch formed inside the passing orifice, an indentation defined between the connecting section and the support section, wherein the drive member is not interfered by the support section by using the indentation, and the movable piece further includes two first joining orifice formed adjacent to an end of the support section opposite to the connecting section.

5. The angle adjustment mechanism as claimed in claim 4, wherein the retainer further includes at least one first protrusion arranged on an end of the multiple second teeth, a circular abutting portion surrounding around a center of the retainer, two opposite second fixing orifices defined on the circular abutting portion and concentric with the first receiving orifice, wherein a first end of each of the at least one first protrusion is engaged by each of the at least one second notch, and a second end of each first protrusion is located inside each of the at least one cutout, the circular abutting portion is limited by the connecting section.

6. The angle adjustment mechanism as claimed in claim 5, wherein the drive member has two third protrusions accommodated in the second receiving orifice, and the drive member has a pull portion extending therefrom and configured to rotate the drive member, wherein the first adjusting member includes two third notches formed on a first outer surface thereof, two second coupling portions arranged on a second outer surface of the first adjusting member, wherein the two third notches are engaged with the two third protrusions respectively, the second adjusting member has a fifth receiving orifice formed in a first end thereof, a sixth receiving orifice defined in a second end of the second adjusting member, and a second threaded orifice defined between and communicating with the fifth receiving orifice and the sixth receiving orifice, wherein the sixth receiving orifice is connected with the first coupling portion, and the adjustment assembly further includes a cap, wherein the cap includes a second joining orifice defined thereon and is received in the second receiving orifice of the drive member, and the second joining orifice is fitted with the two second coupling portions.

7. The angle adjustment mechanism as claimed in claim 6 further comprising a first screwing element and two second screwing elements, wherein the first screwing element is accommodated in the fifth receiving orifice of the second adjusting member and is inserted through the second threaded orifice and the first threaded orifice of the connector so that the second adjusting member is screwed with the connector, and the two second screwing elements are inserted through the two opposite first fixing orifices of the movable piece and the two opposite second fixing orifices of the retainer respectively so that the movable piece is connected with the retainer.

8. The angle adjustment mechanism as claimed in claim 4 further comprising a storage drawer, wherein two angle adjustment mechanisms are screwed on two ends of the storage drawer respectively, the storage drawer includes two slide rails arranged on two bottoms of the two ends of the storage drawer respectively, and each of the two slide rails has an elongated groove defined on a center of each slide rail, a slidable block, and two third screwing elements, wherein the slidable block has two third joining orifices defined on a center thereof and are accommodated in the elongated groove, the two third screwing elements are inserted through the two first joining orifice of the movable piece and the two third joining orifices of the slidable block individually so that the slidable block is connected with the movable piece.

* * * * *